US007930884B2

(12) United States Patent
Leroy et al.

(10) Patent No.: US 7,930,884 B2
(45) Date of Patent: Apr. 26, 2011

(54) EXHAUST MANIFOLD

(75) Inventors: Vincent Leroy, Montbeliard (FR); Patrik Nilsson, Kalmar (SE)

(73) Assignee: Faurecia Systemes d'Echappement, Nanterre (FR)

( * ) Notice: Subject to any disclaimer, the term of this patent is extended or adjusted under 35 U.S.C. 154(b) by 635 days.

(21) Appl. No.: 11/886,067

(22) PCT Filed: Mar. 9, 2006

(86) PCT No.: PCT/FR2006/000529

§ 371 (c)(1), (2), (4) Date: May 30, 2008

(87) PCT Pub. No.: WO2006/095096

PCT Pub. Date: Sep. 14, 2006

(65) Prior Publication Data

US 2009/0031716 A1 Feb. 5, 2009

(30) Foreign Application Priority Data

Mar. 11, 2005 (FR) ..... 05 02438

(51) Int. Cl.
*F01N 1/00* (2006.01)
*B23P 17/00* (2006.01)
*B21D 51/16* (2006.01)

(52) U.S. Cl. ..... 60/323; 29/890.08

(58) Field of Classification Search ..... 60/321–324; 29/890.052, 890.08
See application file for complete search history.

(56) References Cited

U.S. PATENT DOCUMENTS

| | | | | |
|---|---|---|---|---|
| 5,018,661 | A * | 5/1991 | Cyb | 228/176 |
| 5,784,882 | A * | 7/1998 | Bonny et al. | 60/323 |
| 6,018,946 | A * | 2/2000 | Matsumoto | 60/323 |
| 6,082,104 | A | 7/2000 | Hyakutake et al. | |
| 2002/0195083 | A1 * | 12/2002 | Kenyon et al. | 123/323 |

FOREIGN PATENT DOCUMENTS

| | | |
|---|---|---|
| DE | 103 01 395 A | 7/2004 |
| FR | 2 757 565 A | 6/1998 |

* cited by examiner

*Primary Examiner* — Thomas E Denion
*Assistant Examiner* — Audrey Klasterka
(74) *Attorney, Agent, or Firm* — Young & Thompson

(57) ABSTRACT

A manifold for exhaust gases from a motor vehicle engine, includes upper and lower half-shells (18A, 18B) delimiting between them an exhaust gas pipe, and aligned bores designed to be arranged in the extension of the engine exhaust outlets, the half-shells having each a peripheral edge and being attached to each other via at least first segments (20A, 20B) of their peripheral edges welded to each other. The invention is characterized in that there is at least one median plane (P) passing through the bores and traversed at least twice by the first segments (20A, 20B).

10 Claims, 2 Drawing Sheets

EXHAUST MANIFOLD

Figure 1:
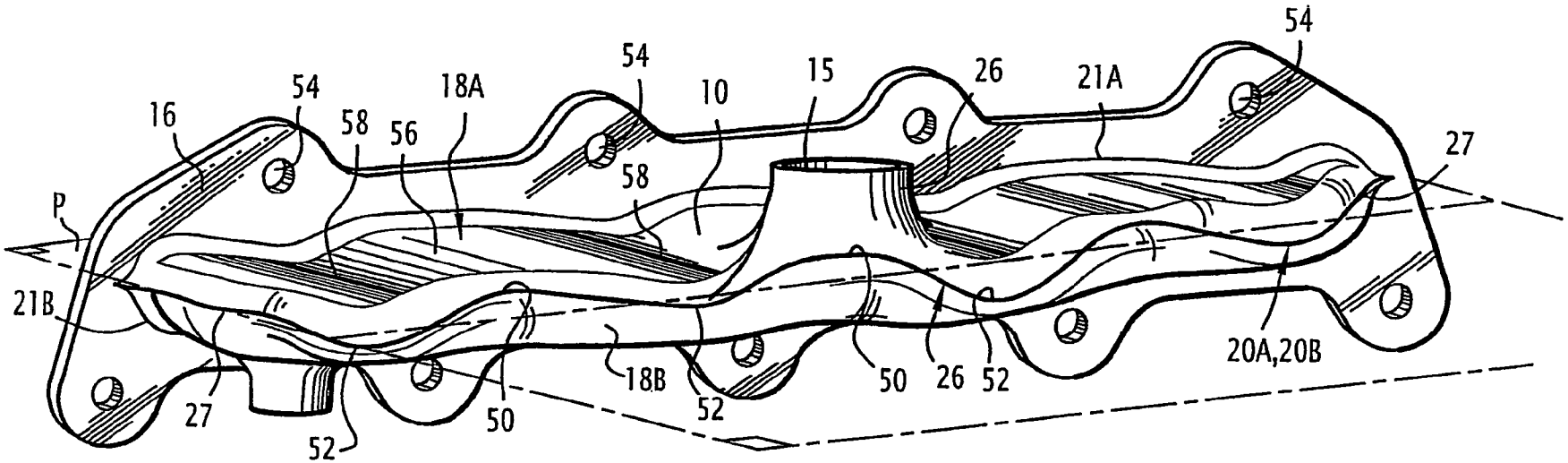

The present invention relates to a manifold for exhaust gases of the type from an internal combustion engine, this manifold comprising upper and lower half-shells which together delimit an exhaust pipe for the gases, and aligned apertures which are intended to be arranged in the continuation of the exhaust outlets of the engine, the half-shells each having a peripheral edge and being bonded to each other by at least first portions of their peripheral edges which are welded to each other.

Manifolds of this type are known and are in particular used to collect exhaust gases at the outlet of the cylinders of an internal combustion engine.

A manifold of this type is described, for example, in the document FR-2 757 565.

The upper half shell carries a pipe which delimits the outlet of the manifold. This pipe is produced by drawing the material which constitutes the half-shell and is a fragile zone, in particular during occurrences of high thermal stress. It has been found that cracks are formed at the base of the pipe after a prolonged period of use of the exhaust manifold.

In this context, the object of the invention is to provide a manifold for exhaust gases which is mechanically stronger than those of the prior art.

To this end, the invention relates to an exhaust gas manifold of the above-mentioned type, characterised in that there is at least a centre plane which extends through the apertures and through which the first portions extend at least twice.

According to specific embodiments, the exhaust gas manifold may comprise one or more of the following features:

the first portions form an alternate arrangement of projections and recesses which extend above and below the centre plane, respectively;

the upper half-shell is arranged substantially above the centre plane and the lower half-shell is arranged substantially below the centre plane;

the upper half-shell comprises a mechanically fragile zone in the region of the first portions, these forming a projection along this fragile zone;

the mechanically fragile zone is an outlet pipe of the manifold;

the manifold comprises a flange to which the upper and lower half-shells are welded by means of second portions of their respective peripheral edges which extend parallel with each other in a general direction which is substantially parallel with the centre plane above and below the centre plane, respectively, the flange comprising a plurality of fixing holes which are spaced in this general direction and which are arranged alternately above the second portion of the upper half-shell and below the second portion of the lower half-shell, a central portion of the first portions extending parallel with the general direction and forming projections opposite the holes which are located below the centre plane and the recesses opposite the holes located above the centre plane; and the upper and lower half-shells form parallel waves which are defined respectively in the continuation of the projections and the recesses of the central portion of the first portions.

Figure 2:
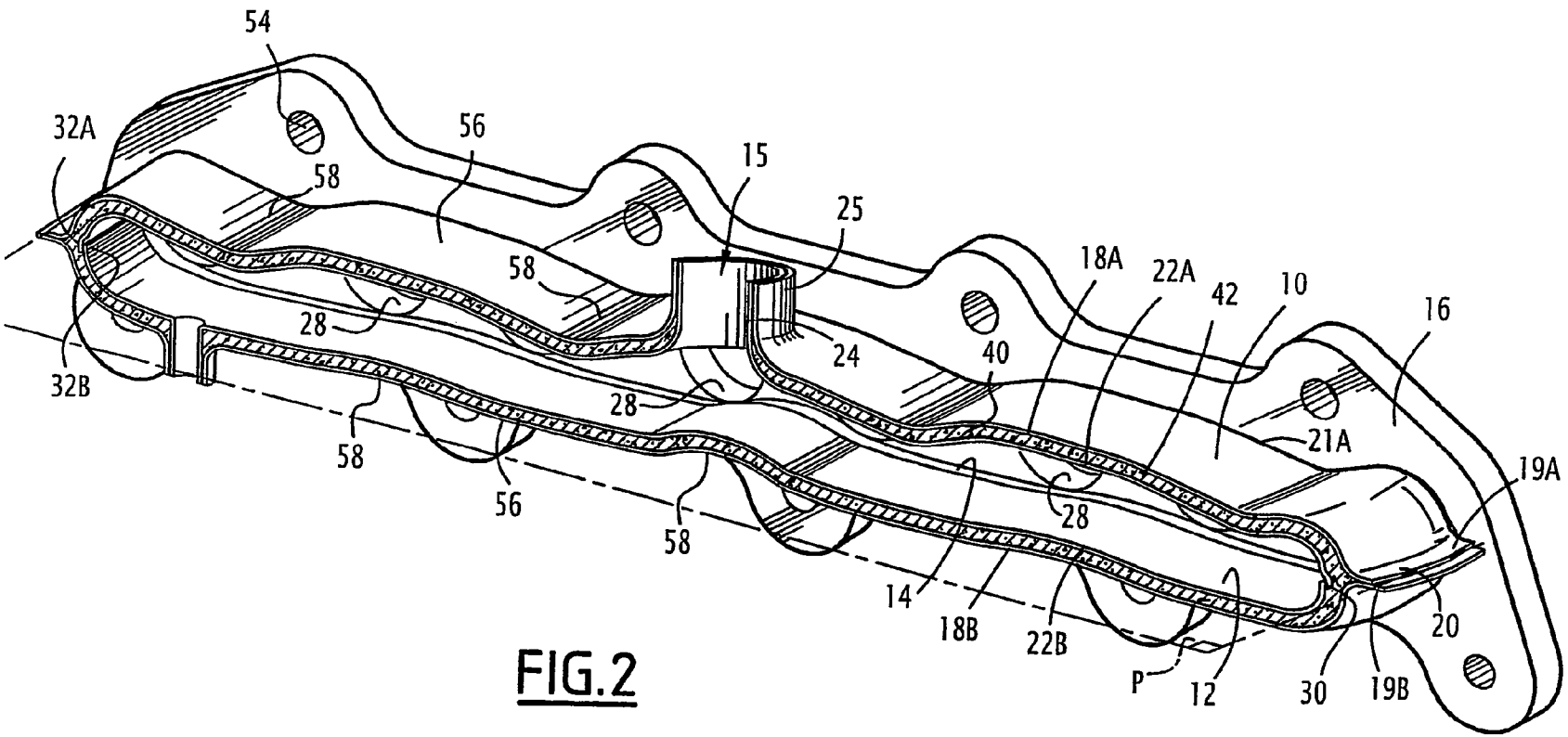

The invention will be better understood from a reading of the following description given purely by way of example and with reference to the drawings, in which:

FIG. 1 is a rear perspective view of a manifold according to the invention; and FIG. 2 is a sectioned perspective view of the manifold of FIG. 1.

The manifold which is illustrated in FIGS. 1 and 2 substantially comprises a sealed outer casing 10 and an inner shell 12 for guiding and discharging the exhaust gases. The inner shell 12 delimits an elongate mouth 14 for collecting the gases in which each exhaust outlet of a cylinder opens. The inner shell 12 also has a common outlet 15 for discharging the gases out of the manifold.

The casing 10 comprises a flange 16 for fixing the manifold to the engine and two upper and lower half-shells 18A, 18B delimited by respective peripheral edges 19A, 19B, the half-shells 18A, 18B being coupled to each other by means of first portions 20A, 20B of these peripheral edges. The first portions 20A, 20B are fixed to each other by means of a weld seam 20. The half-shells 18A, 18B are also welded to the flange 16 by means of second portions 21A, 21B of their respective peripheral edges 19A, 19B.

The inner shell 12 is formed by two half-shells 22A, 22B which are welded to each other in a sealed manner.

One of the half-shells 22A comprises a drawn pipe 24 which delimits the outlet 15 of the manifold. The pipe 24 extends axially in a corresponding pipe 25 delimited in the upper half-shell 18A of the outer casing 10.

The flange 16 is a thick planar plate, which is elongate in a longitudinal direction. The second portions 21A, 21B are welded to a large face of the flange 16 and extend parallel with each other in the general longitudinal direction.

The upper and lower half-shells 18A, 18B are concave pressed components having mutually facing concavity and extending generally perpendicularly relative to the flange 16.

The first portions 20A, 20B of the peripheral edges 19A, 19B extend from a longitudinal end of the flange 16 as far as the opposing longitudinal end of the flange 16, and comprise a central portion 26 which extends substantially parallel with the longitudinal direction and two opposing lateral portions 27 which join the ends of the central portion 26 to the second portions 21A, 21B.

It can be seen in FIG. 2 that the first portions 20A, 20B of the peripheral edges 19A, 19B are substantially coplanar and are pressed one against the other.

The inner shell 12 is welded to the flange 16 along an edge which delimits the elongate mouth 14 which covers apertures 28 which are provided in the flange 16 and which are intended to be arranged in the continuation of the exhaust outlets of the cylinders of the engine. The apertures 28 are circular and their centres are aligned longitudinally.

The two half-shells 22A, 22B are welded to each other by means of a peripheral weld seam 30 which is produced between two lateral peripheral regions designated 32A, 32B of the two half-shells. The peripheral regions 32A, 32B overlap. To this end, the half-shell 22A has a shoulder 34 which delimits, with the edge of the half-shell, the region 32A which is slightly recessed towards the outer side. The region 32B of the associated half-shell 22B is received in the recess delimited by the shoulder 34.

In this manner, the outer surface of the half-shell 22B is pressed against the inner surface of the half-shell 22A along the overlapping regions 32A, 32B.

The overlapping regions 32A, 32B extend perpendicularly relative to the connection plane between the two half-shells 22A, 22B so that each region forms an irregular cylindrical surface which is generated by a segment which is perpendicular relative to the connection plane and which extends along the weld seam 30.

An interposed free space 40 is formed between the inner shell 22 and the outer casing 18. This space 40 has a thickness which is between 1 mm and 30 mm.

In this manner, the inner shell 12 is spaced-apart at all points from the outer casing 18. In particular, the connection regions where the weld seams 20 and 30 are arranged are completely separate.

A thermal and/or acoustic insulating material 42 is interposed in the interposed space between the inner shell 12 and the outer casing 18. It completely fills this space.

The material is formed, for example, from a sheet of fibres, such as ceramic fibres.

As can be seen in FIG. 1, the upper half-shell 18A is arranged substantially above a centre plane P and the lower half-shell 18B is arranged substantially below this centre plane P.

This plane P is parallel with the longitudinal direction which is substantially perpendicular relative to the flange 16 and contains the centres of the apertures 28.

It should be noted that the half-shells 18A and 18B are assembled with each other in a direction perpendicular relative to the centre plane P.

The path of the first portions 20A/20B defines a derivable curve, that is to say, which has no acute angle such as that formed between two straight segments having different orientations.

The first portions 20A, 20B of the peripheral edges 19A, 19B extend along a sinuous path and extend through the centre plane P several times. The first portions 20A, 20B therefore form an alternate arrangement of projections 50 and recesses 52 which extend above and below the centre plane P, respectively.

The period of the oscillations, that is to say, the spacing which separates the peak of two projections is between 5 and 20 cm. The size of the oscillations, that is to say, the height of the peak of the projection relative to the centre plane P is between 1 and 5 cm.

In particular, the first portions 20A, 20B form a projection 50 along the pipe 25 which constitutes a fragile zone of the upper half-shell 18A.

The second portions 21A, 21B of the peripheral edges 19A, 19B extend parallel with the centre plane P above and below this centre plane P, respectively.

It can be seen in FIG. 1 that the flange comprises a plurality of fixing holes 54 which are longitudinally spaced-apart and arranged alternately above the second portion 21A of the upper half-shell 18 and below the second portion 21B of the lower half-shell 18B.

The first portions 20A, 20B form projections 50 opposite holes 54 which are located below the centre plane P and recesses 52 opposite holes which are located above the centre plane P. That is to say, the projections 50 and the recesses 52 are arranged in the continuation of the holes 54 located above and below the centre plane P, respectively, in a transverse direction substantially perpendicular relative to the flange 16.

It can also be seen in FIG. 1 that the upper and lower half-shells 18A, 18B each form a succession of transverse parallel waves 56 separated by parallel transverse depressions 58. The waves 56 formed by the upper half-shell 18A are defined in the continuation of the projections 50 of the central portion 36 of the first portions 20A, 20B. The waves 56 of the lower half-shell 18B are defined in the continuation of the recesses 52 of the central portion of the first portions 20A, 20B, so that the half-shells 18A and 18B, when viewed in section in a plane parallel with the flange 16 (FIG. 2), have mutually parallel sinuous forms.

The second portions 21A, 21B also have a sinuous form, as indicated in FIGS. 1 and 2, and also form projections 50 and recesses 52 which are defined in the transverse continuation of the waves 56 and depressions 58 of the upper and lower half-shells 18A, 18B.

In order to produce a manifold of this type, the two half-shells 22A, 22B are formed by means of pressing, then the pipe 24 is formed by means of material drawing, for example, by means of rotomoulding on a core having an appropriate shape. Finally, the half-shells 22A, 22B are connected to each other by means of formation of the weld seam 30.

The inner shell is then welded to the flange at the periphery of the elongate mouth 14 thereof.

The insulating material 42 which is initially in the form of a sheet is then attached and wound around the inner shell 12.

The two half-shells 18A, 18B are first shaped by means of pressing, which allows the first and second portions of the peripheral edges to be given their sinuous shapes. Then, the pipe 25 is formed by means of material drawing, for example, by means of rotomoulding around a core having a suitable shape. The half-shells are then positioned around the insulating material and are connected together by producing the weld seam 20. Finally, the outer casing 10 is welded to the flange.

The manifold described above has significant advantages.

The fact that the peripheral edge of the upper half-shell 18A forms a projection along the pipe 25 allows the mechanical stresses to be reduced in this zone. The material is displaced in this zone towards the outer side of the half-shell at the pressing stage. During the formation stage of the pipe 25, this material is drawn further towards the outer side of the half-shell from the position occupied at the end of pressing. It is therefore subject to a drawing operation of a lesser amplitude than if the peripheral edge had a straight profile at that location. The mechanical stresses in this zone are therefore reduced, which reduces the risks of cracking in the long term.

Furthermore, the depressions 58 which are provided in the continuation of the holes 54 of the flange 16 facilitate the use of tools such as electric or pneumatic screwdrivers to fix the manifold to the engine. This operation first requires screws to be placed in the holes of the flange 16, then requires the tool to be moved towards the holes at the side of the half-shells in order to fix the screws. The existence of the depressions 58 facilitates the clearance of the tool above or below the half-shells.

It should be noted that projections may be formed in the peripheral edges not only along the length of the pipe but also along any other zone of the half-shells in which it is desirable to reduce the level of mechanical stresses.

The invention claimed is:

1. A manifold for exhaust gases from an internal combustion engine, this manifold comprising upper and lower half-shells (18A, 18B) which together delimit an exhaust pipe for the gases, and aligned apertures (28) which are intended to be arranged in the continuation of the exhaust outlets of the engine, the half-shells each having a peripheral edge (19A, 19B) and being bonded to each other by at least first portions (20A, 20B) of their peripheral edges (19A, 19B) which are welded to each other, characterised in that there is at least a centre plane (P) which extends through the apertures (28) and through which the first portions (20A, 20B) extend at least twice, and in that the first portions (20A, 20B) form an alternate arrangement of projections (50) and recesses (52) which extend above and below the centre plane (P), respectively.

2. The manifold according to claim 1, characterised in that the upper half-shell (18A) is arranged substantially above the centre plane (P) and the lower half-shell (18B) is arranged substantially below the centre plane (P).

3. The manifold according to claim 2, characterised in that the upper half-shell (18A) comprises a mechanically fragile zone (25) in the region of the first portions (20A, 20B), these forming a projection (50) along this fragile zone (25).

4. The manifold according to claim 2, characterised in that it comprises a flange (16) to which the upper and lower half-shells (18A, 18B) are welded by means of second portions (21A, 21B) of their respective peripheral edges (19A, 19B) which extend parallel with each other in a general direction which is substantially parallel with the centre plane (P) above and below the centre plane (P), respectively, the flange (16) comprising a plurality of fixing holes (54) which are spaced in this general direction and which are arranged alternately above the second portion (21A) of the upper half-shell (18A) and below the second portion (21B) of the lower half-shell (18B), a central portion (26) of the first portions (20A, 20B) extending parallel with the general direction and forming projections (50) opposite the holes (54) which are located below the centre plane (P) and the recesses (52) opposite the holes (54) located above the centre plane (P).

5. The manifold according to claim 1, characterised in that it comprises a flange (16) to which the upper and lower half-shells (18A, 18B) are welded by means of second portions (21A, 21B) of their respective peripheral edges (19A, 19B) which extend parallel with each other in a general direction which is substantially parallel with the centre plane (P) above and below the centre plane (P), respectively, the flange (16) comprising a plurality of fixing holes (54) which are spaced in this general direction and which are arranged alternately above the second portion (21A) of the upper half-shell (18A) and below the second portion (21B) of the lower half-shell (18B), a central portion (26) of the first portions (20A, 20B) extending parallel with the general direction and forming projections (50) opposite the holes (54) which are located below the centre plane (P) and the recesses (52) opposite the holes (54) located above the centre plane (P).

6. The manifold according to claim 5, characterised in that the upper and lower half-shells (18A, 18B) form parallel waves (56) which are defined respectively in the continuation of the projections (50) and the recesses (52) of the central portion (26) of the first portions (20A, 20B).

7. The manifold according to claim 1, characterised in that the upper half-shell (18A) comprises a mechanically fragile zone (25) in the region of the first portions (20A, 20B), these forming a projection (50) along this fragile zone (25).

8. The manifold according to claim 7, characterised in that it comprises a flange (16) to which the upper and lower half-shells (18A, 18B) are welded by means of second portions (21A, 21B) of their respective peripheral edges (19A, 19B) which extend parallel with each other in a general direction which is substantially parallel with the centre plane (P) above and below the centre plane (P), respectively, the flange (16) comprising a plurality of fixing holes (54) which are spaced in this general direction and which are arranged alternately above the second portion (21A) of the upper half-shell (18A) and below the second portion (21B) of the lower half-shell (18B), a central portion (26) of the first portions (20A, 20B) extending parallel with the general direction and forming projections (50) opposite the holes (54) which are located below the centre plane (P) and the recesses (52) opposite the holes (54) located above the centre plane (P).

9. The manifold according to claim 7, characterised in that the mechanically fragile zone is an outlet pipe (25) of the manifold.

10. The manifold according to claim 9, characterised in that it comprises a flange (16) to which the upper and lower half-shells (18A, 18B) are welded by means of second portions (21A, 21B) of their respective peripheral edges (19A, 19B) which extend parallel with each other in a general direction which is substantially parallel with the centre plane (P) above and below the centre plane (P), respectively, the flange (16) comprising a plurality of fixing holes (54) which are spaced in this general direction and which are arranged alternately above the second portion (21A) of the upper half-shell (18A) and below the second portion (21B) of the lower half-shell (18B), a central portion (26) of the first portions (20A, 20B) extending parallel with the general direction and forming projections (50) opposite the holes (54) which are located below the centre plane (P) and the recesses (52) opposite the holes (54) located above the centre plane (P).

* * * * *